United States Patent [19]

Mariani

[11] 4,224,707

[45] Sep. 30, 1980

[54] FLOATING APPARATUS FOR THE REMOTE MARKING OF THE POSITION OF BODIES FALLEN IN WATER

[76] Inventor: Giulio Mariani, Via Paola Falconieri, 45, 00152 Roma, Italy

[21] Appl. No.: 880,170

[22] Filed: Feb. 21, 1978

[30] Foreign Application Priority Data

Feb. 21, 1977 [IT] Italy ..... 48144 A/77

[51] Int. Cl.[2] ..... B63C 9/18

[52] U.S. Cl. ..... 9/8 R; 9/14; 116/107; 116/173

[58] Field of Search ..... 9/8 R, 8.3 R, 11 R, 9/11 A, 9, 14, 8.3 E; 52/2; 152/339, 331, 319; 116/107, 173, DIG. 7, DIG. 8

[56] References Cited

U.S. PATENT DOCUMENTS

| | | | |
|---|---|---|---|
| 754,645 | 3/1904 | Dupont | 152/331 |
| 3,149,352 | 9/1964 | Christiansen | 9/8 |
| 3,433,323 | 3/1969 | Ukawa | 52/2 |
| 3,709,044 | 1/1973 | Chacko | 9/11 |
| 3,760,441 | 9/1973 | Handelman | 9/14 |
| 3,875,602 | 4/1975 | Miron | 9/8.3 |
| 3,921,120 | 11/1975 | Widenhofer | 9/8 |

*Primary Examiner*—Tyrgve M. Blix
*Assistant Examiner*—Winston H. Douglas
*Attorney, Agent, or Firm*—Young & Thompson

[57] ABSTRACT

Floating apparatus for the remote marking of the position of bodies that have fallen in water, comprises a buoyant body which is ballasted on its underside and which on its upper side carries an inflatable standard having a visible signal at its upper end. The inflatable standard is in the form of inner and outer tubes which define between them a hollow chamber that extends lengthwise of the standard and parallel to the standard. A supply of compressed gas, carried by the apparatus, is selectively releasable to fill the hollow chamber to erect the standard.

1 Claim, 6 Drawing Figures

FLOATING APPARATUS FOR THE REMOTE MARKING OF THE POSITION OF BODIES FALLEN IN WATER

This invention relates to a floating apparatus for the remote marking of the position of bodies fallen in water; more precisely, it relates to a floating apparatus provided with a flexible, inflatable member having reduced dimensions, when stored or not in use, this member being able to reach automatically an elongated, straight position when thrown overboard, to permit a short or long distance sighting of the zone where a body is floating in the water.

As sailors know very well, one of the most serious problems of safety at sea is to accurately mark the position of a man fallen overboard in order to rescue him as quickly as possible.

For this purpose there are some official rules or recommendations which require the presence on board of life belts, which can be provided with visual signalling means, such as lights or smoke signals. However, a life belt has the main drawback of being very low when floating in the water, thus being virtually invisible but in a very flat sea, even if provided with light—emitting sources. On the other hand, smoke signals are of limited useful life and the smoke can be easily dispersed by the wind.

An international racing rule prescribes the presence on board of a suitably ballasted buoy for a racing yacht, this buoy being provided with a four-meter long pole carrying a flag on the uppermost end thereof. Some of these poles are telescopically extendable, but despite the reduced size thereof, the marking apparatus is cumbersome for small yachts. Furthermore, even if such an apparatus can be considered a necessary evil on a racing yacht, on a cruising yacht, where perhaps it could be far more useful, a buoy having a four-meter long pole is likely to be very soon left ashore.

Moreover, even if telescopic poles are more easily stowed, they have the drawback of requiring a considerable time to reach the fully extended condition thereof on a yacht at sea; another drawback is that the various segments of the telescopic pole can disengage from each other, due to the motion imparted by the waves thereto, thus shortening the pole.

All these devices require the presence of somebody on deck for sighting the man fallen overboard, which is not always possible.

In another attempt to solve this problem, some small transmitters were devised, which can be carried by everybody on deck, these transmitters being powered by batteries actuated upon the sea water entering the battery and emitting a single note of a given wavelength, thus highly facilitating the heading for this signal by means of a radiogoniometer. In any case, this kind of safety device is very expensive and cannot be universally adopted.

It is an object of the invention to improve safety at sea by means of a simple, low-cost, selfactuating apparatus which, when thrown overboard, can exactly mark the position where a man was lost.

Another object of the invention is to provide a similar apparatus of smaller size which every crewman can permanently carry in order to show his position in case he falls overboard.

The apparatus according to the invention comprises a floating body provided with flexible means adopted to be folded, thus occupying a limited space when stowed, and to reach an elongated, straight condition if inflated by a compressed gas; means for supplying this compressed gas; and means for automatically releasing this compressed gas when the apparatus reaches the water.

Another optional feature of the apparatus according to the invention is that it can be provided with means for emitting a high-intensity visual signal.

The invention will be now described in detail with reference to two possible embodiments thereof shown, as a non limitative example, in the annexed drawing, wherein.

Figure 1:
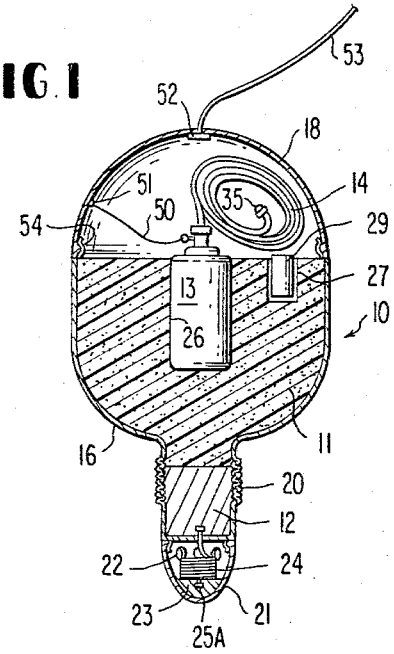
FIG. 1 is a vertical sectional view of a first embodiment of the floating apparatus according to the invention, in the stowage condition.
Figure 2:
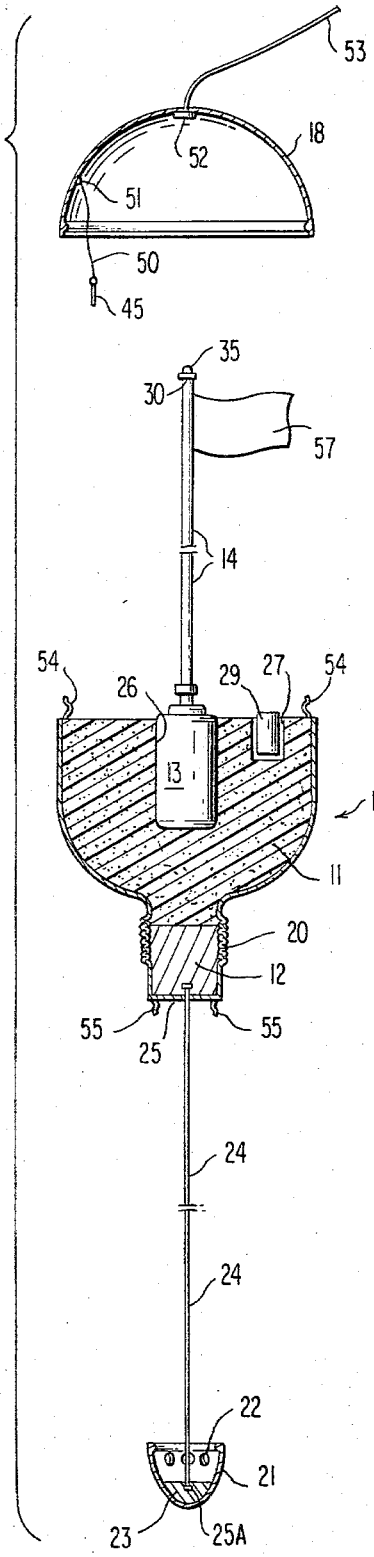
FIG. 2 is a view, of the apparatus of FIG. 1 in the extended condition thereof.
Figure 6:
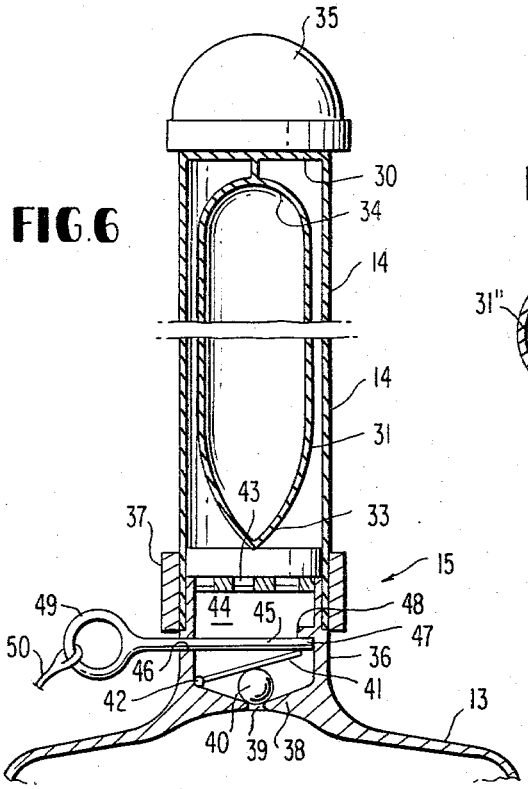
FIG. 6 is a further detail showing, in enlarged scale, the engagement of the tubular inflatable member with its supporting member.

Referring first to FIGS. 1 and 2, a first embodiment of the apparatus of the invention comprises a hollow body 10, of a material adapted to form a rigid shell, such a an antishock plastic material, a body 11 that fills body 10 and is adapted to make it float, a ballasting member 12, a gas bottle 13 containing an inflation gas, a tubular flexible and inflatable member 14 and a unit comprising gas supplying means and valve means, adapted to inflate and to maintain tubular member 14 in the inflated extended condition thereof, this unit being generally referred to with reference 15 in FIG. 6. Hollow body 10 is made of a lower part 16 and an upper part 18 closing lower part 16.

Lower part 16 of body 10 is filled with body 11 of a material suitable to make it float under in any conditions, such as a closed-cell plastic foam, and it is provided with a hollow extension 20, preferably of telescopic construction, carrying member 12. The lowermost part of extension 20 carries a stationary cap 21 having a plurality of holes 22 and a small ballast 23, cap 21 being connected to end 25 of extension 20 by a cord 24 which is in turn anchored to ballast 23 at 25A.

Figure 4:
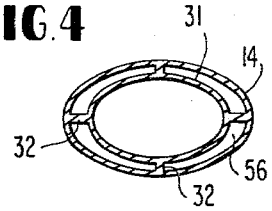
FIG. 4 is a detail of a suitable cross section of the tubular inflatable member according to the invention.
Figure 5:
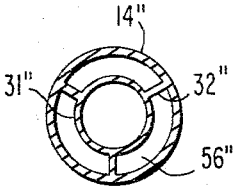
FIG. 5 is a similar detail of a second suitable cross section of the tubular inflatable member.

Body 11 has two cavities; cavity 26 receives gas bottle 13, while cavity 27 receives a battery 29 which is operated upon the water entering it. Neck 36 of bottle 13 tightly receives the end of a flexible inflatable tube 14, whose other end 30 is closed. Tube 14 is double walled and has an inner wall 31 and a plurality of longitudinal ribs 32 (FIGS. 4 and 5) connecting inner wall 31 to outer wall 14. Inner wall 31 is closed at lower end 33 thereof, as shown in FIG. 6, upper end 34 thereof being connected to the exterior through a light source, such as lamp 35. FIG. 6 also shows lamp 35 which is placed at upper end 30 of tube 14, the lamp being connected to battery 29 by means of a suitable lead (not shown).

A device for automatically releasing the gas will be now described as a non limitative example. Neck 36 of gas bottle 13 (the lower end of tube 14 being tightly received in neck 36 and held in place, for example, by belt 37) carries valve unit 15 which comprises:

a lower wall 38 of neck 36, forming a valve seat having a central opening 39;

a ball-valve element 40, pressed against valve seat 38 to close opening 39 through elastic tab 41, which is hinged on the inner wall of neck 36 at 42, and a valve cage 43 closing a chamber 44 defined by wall 38 and cage 43.

Elastic tab 41 is pushed downward in the Figure by a movable pin 45 fitted into chamber 44 through a hole 46 on neck 36, end 47 of pin 45 being fitted below a projection 48 extending outwardly of the inner surface of neck 36, so as to hold ball 40 against valve seat 38, thus closing opening 39.

Outer end 49 of movable pin 45 is ring-shaped and one end of a short cord 50 is anchored thereto, the other end of cord 50 being connected to the inner surface of cap 18 at 51.

Furthermore, the end of another cord 53 is fixed to the outer surface of cap 18 at 52, the other end of cord 53 being fixed directly to an element of the boat.

Cap 18 and cap 21 are connected to body 16 and extension 20, respectively, by means of a plurality of elastic pressure strips 54 and 55, respectively.

In practice, for example if a man falls overboard, it will be sufficient to throw the apparatus of the invention into the sea, which apparatus can be as big as a small buoy. In such a case, cap 18 held by cord 53 will detach from body 16 and, once the cord is completely extended, it will pull pin 45 out of hole 46. Thus, ball 40 will rise from opening 39 allowing the compressed gas to be released from bottle 13. The compressed gas, as shown in FIG. 6, will flow into inflatable tube 14 and, more precisely, into gap 56 between tube 14 and inner wall 31 thereof, thus inflating tube 14 and extending it to the position shown in FIG. 2.

It is necessary to point out that the particular structure of tube 14, with its inner wall 31 being under a lower pressure than space 56, renders it extremely rigid when inflated, which allows tube 14 to become a suitable pole for carrying a small flag or a lamp at the uppermost end thereof. This lamp allows easy sighting and rescue of a man even in the dark. Once the apparatus reaches the water surface, cap 21 will remove from end 25 of extension 20, due to its ballast 23, thus acting as a sea anchor and preventing the apparatus from drifting.

Figure 3:
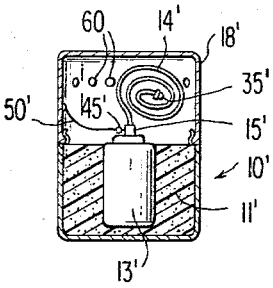
FIG. 3 is a vertical sectional view of a second embodiment of the invention.

FIG. 3 shows a second embodiment of the invention, which can be considered as personal equipment for each crewman. The apparatus according to this embodiment is similar, in the main outlines, to the apparatus shown in FIGS. 1, 2 and 6, and similar parts thereof have been referred to with the same numerals with a prime.

This second embodiment essentially comprises an outer body 10' a gas bottle 13', an inflatable element 14', a cap 18' with a plurality of holes 60, a floating body 11', valve means 15' with a movable pin 45' fixed to cap 18' by means of a cord 50'.

The operation of this second embodiment is exactly the same as that of the first embodiment, except that pin 45' is manually extracted.

In both embodiments, gas bottle 13 or 13' can be replaced by a chamber containing a substance which reacts with water thus generating a gas which inflates tube 14 or 14'.

Suitable means allowing the water to enter the above described chamber and preventing the generated gas from escaping from it are already known and, accordingly, they will not be described herein.

I claim:

1. Apparatus for improving safety at sea, comprising a buoyant body, ballast means on the underside of the buoyant body to maintain the buoyant body in an upright attitude in the water, an inflatable standard carried by the buoyant body in a position such that when inflated the standard is erect and rises a substantial distance above the surface of the water, signal means at the upper end of the standard, the standard being hollow and comprising an outer wall and at least one inner wall disposed within the outer wall, the inner and outer walls defining between them at least one hollow chamber that extends continuously full length of the standard parallel to the length of the standard, and means carried by the apparatus to supply compressed gas to the interior of only said at least one hollow chamber.

* * * * *